US005150022A

United States Patent [19]

Waddington

[11] Patent Number: 5,150,022

[45] Date of Patent: Sep. 22, 1992

[54] PRESS FEEDER AND PILOT RELEASE USING SERVO CONTROL

[75] Inventor: John E. Waddington, Richmond, R.I.

[73] Assignee: Waddington Electronics, Inc., Cranston, R.I.

[21] Appl. No.: 664,655

[22] Filed: Mar. 5, 1991

[51] Int. Cl.[5] ..... G05B 9/02

[52] U.S. Cl. ..... 318/563; 318/705; 271/8.1; 83/367

[58] Field of Search ..... 318/560-563, 318/567, 569, 571, 600, 601, 77, 85, 700, 705; 72/68, 105, 107; 83/30, 40-42, 225-228, 360, 365, 366, 367-370; 271/3, 4, 8.1, 10, 264, 265, 278, 176

[56] References Cited

U.S. PATENT DOCUMENTS

| | | | |
|---|---|---|---|
| 1,859,962 | 5/1932 | Ferenci . | |
| 3,067,999 | 12/1967 | Skeen . | |
| 3,213,733 | 10/1965 | Glendening . | |
| 3,656,384 | 4/1972 | Chandler | 83/278 X |
| 3,889,565 | 6/1975 | Vecchi . | |
| 3,987,283 | 10/1976 | Moeller | 318/563 |
| 4,329,898 | 5/1982 | Pawelko et al. . | |
| 4,397,170 | 8/1983 | Seebach, Jr. | 72/68 |
| 4,429,602 | 2/1984 | Vits . | |
| 4,699,031 | 10/1987 | D'Angelo et al. . | |
| 4,860,619 | 8/1989 | Yunoki . | |

OTHER PUBLICATIONS

"Advances in Press Feeds for Coil Stock, Part 1: Slide Feeds" by Charles Wick, *Manufacturing Engineering*, Feb. 1980, pp. 68-70.

"Advances in Press Feeds for Coil Stock, Part 2: Roll Feeds" by Charles Wick, *Manufacturing Engineering*, Mar. 1980, pp. 84-88.

"Advances in Press Feeds for Coil Stock-Part 3: Independent Roll Feeds" by Charles Wick, *Manufacturing Engineering*, Apr. 1980, pp. 112-114.

*American Tool, Die and Stamping News*, May/Jun. 1990, p. 41.

*Precision Roll Feed News*, Sep. 1990.

*Precision Roll Feed News*, May 1990, pp. 1-5.

*Synchro & Resolver Converters.*

Pacific Scientific pamphlet, Copyright 1987.

Synchro/resolver conversion.

*Primary Examiner*—William M. Shoop, Jr.

*Assistant Examiner*—David Martin

*Attorney, Agent, or Firm*—Hamilton, Brook, Smith & Reynolds

[57] ABSTRACT

A pilot release for a press feeder has a spring-loaded support for one of two pinch rollers through which stock material is fed. A cam follower attached to the support engages a cam which is driven by a servo motor. During operation of the press, a position sensor on the press outputs a signal indicative of the position of the press crankshaft. The signal is input to a signal processor which includes a motor control circuit which drives the servo motor of the press feeder. A position sensor on the servo motor also inputs a signal to the signal processor which compares the position of the press to the position of the servo motor, and drives the servo motor to synchronize the motor to the press. The synchronization is such that as pilot pins of the press contact the stock material in the press, an eccentricity of the cam engages the cam follower. The spring-loaded support is thereby pivoted against the tendency of the spring, and the pinch rollers are momentarily separated, removing tension from the stock material and allow alignment by the pilot pins.

18 Claims, 7 Drawing Sheets

PRESS FEEDER AND PILOT RELEASE USING SERVO CONTROL

BACKGROUND OF THE INVENTION

In the field of automatic stamping or punching presses, coiled stock material is often fed into a press by a press feeder placed near the front of the press. A common method of feeding the stock material into the press is by passing it through a pair of pinch rollers which apply friction to the material, and rotate in a cooperative manner to feed the stock into the press. By linking the rotation of the pinch rollers to the speed of the press, the stock material is fed into the press at the proper rate.

When a press is performing a punching operation, it is often desirable to align the punched holes as accurately as possible. One method of doing this uses pilot pins in the press which contact the material shortly before the press actually punches the material. The pilot pins are positioned to contact the material in a region where holes have already been punched by the press. The material is advanced to approximately the correct location by the press feeder. More precise positioning of the material then occurs as the pilot pins enter the previously punched holes, and draw them into alignment with the pilot pins. However, for this alignment to take place, the tension applied to the stock material by the pinch rollers of the press feeder must be removed.

SUMMARY OF THE INVENTION

In accordance with the present invention an apparatus is provided for feeding stock into a press. For use with pilot pin adjustment, the present invention releases tension on the stock material in synchronization with the press stroke, without mechanical linkage to the press itself. A first pinch roller is rotatably secured to a housing. A second pinch roller is positionable adjacent the first pinch roller, allowing stock material to be fed through the pinch rollers under tension from the rollers. Thus, an equal and opposite rotation of the rollers, in cooperation with one another, results in an advancement of the stock material through the apparatus.

The second pinch roller is secured to a pivotable support such that a pivoting of the support in a first direction causes the second pinch roller to move away from the first pinch roller. A spring element is provided which provides a bias which urges the second pinch roller toward the first pinch roller. A cam follower is secured to the pivotable support, and is engaged by a rotatable cam. Rotation of the cam initiates a periodic pivoting of the pivotable support against the bias of the spring element. For adjustment purposes, a travel adjust screw is provided with the press feeding apparatus for adjusting the amount of pivoting of the pivotable support when the cam follower is engaged by the cam. The cam itself may be selected to provide the desired release time, by proper selection of the size of the cam eccentricity.

A sensor, preferably a resolver, senses the position of the press and generates an output indicating the press position. The output from the sensor is input to a signal processor which correspondingly outputs a motor control signal. The motor control signal is used to drive a servo motor which causes rotation of the cam in response to the signal received from the signal processor. In the preferred embodiment, the servo motor is part of a motor assembly which includes a resolver for sensing the position of the servo motor shaft. The servo motor resolver provides an output to the signal generator. The entire servo motor assembly is rigidly secured to the top of the press feeding apparatus.

The signal processor uses a resolver-to-digital converter in processing the signal from the press resolver. In the preferred embodiment, only two of sixteen position output pins are used by the signal processor. The outputs on the two pins are adjacent bits of a digital word, such that the signals on the two pins are at a 90° phase shift relationship to one another. The signal processor also uses a motor controller which includes several manual switches. These switches include a "start" switch, a "stop" switch, and an "open/close" switch for advancing the motor one half turn.

DETAILED DESCRIPTION OF THE PREFERRED EMBODIMENT

Figure 1:
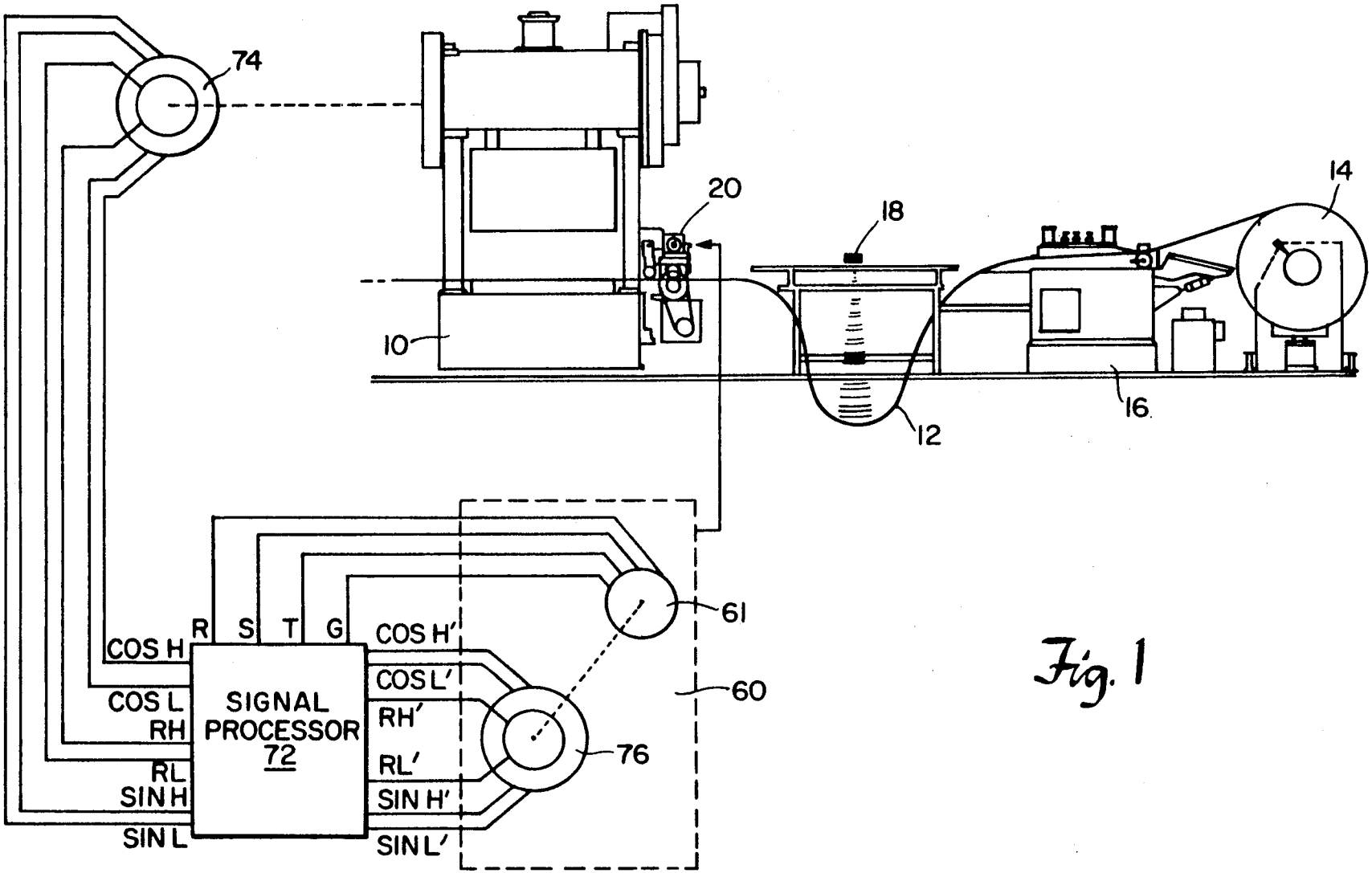
FIG. 1 shows a press into which stock material is being fed by a press feeder, along with a schematic illustration of a servo control apparatus linking the press to the press feeder.

Shown in FIG. 1 is a typical stamping or punching press 10 which is operating on a piece of metal stock 12 being fed into the press from a coil 14. A stock straightener 16 is employed for straightening the stock coming off the coil 14. Stock loop detector 18 is used to ensure that the proper slack in the stock is maintained. Controlling the feed of the stock 12 into the press 10 is a press feeder 20, which is shown in more detail in the cross section of FIG. 2. The rollers 22, 24 of the press feeder 20 apply tension to the stock 12. Roller 22 rotates clockwise and roller 24 rotates counter-clockwise, such that the stock is fed into the press. The roller 24 is connected by a belt to a motor which drives it in a counter-clockwise direction. The roller 22 is a passive roller, and the tension between the rollers and the stock 12 causes the roller 22 to rotate clockwise, following the motion of the stock and roller 24.

Figure 2:
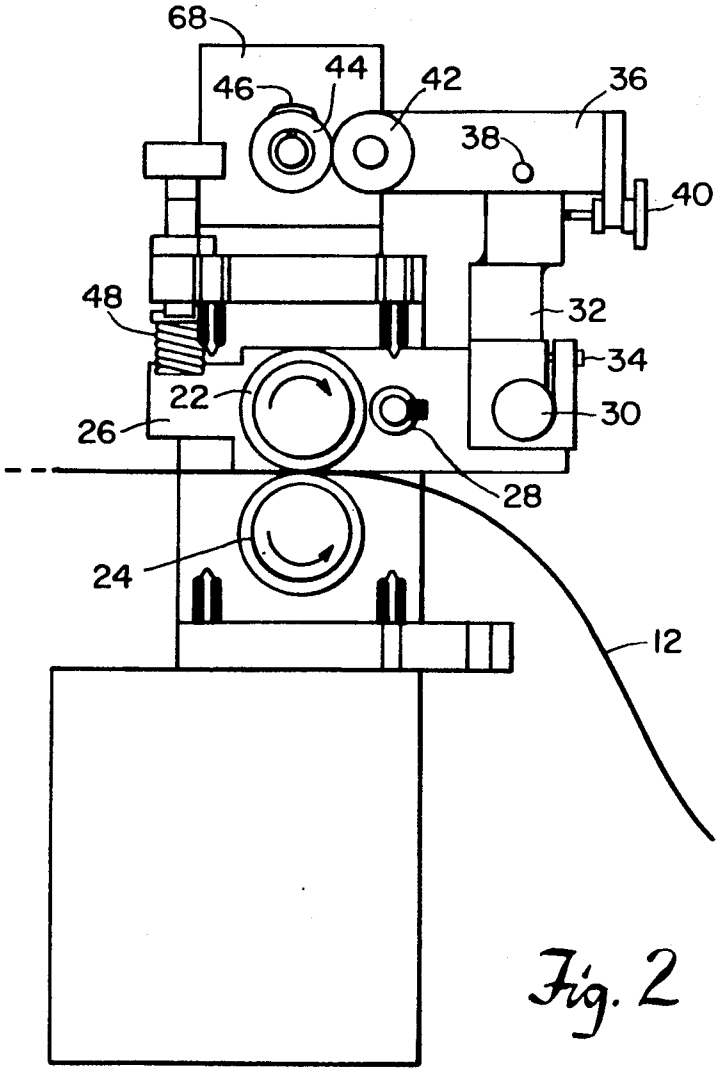
FIG. 2 is a cross section of the press feeder of FIG. 1.

Because the press 10 uses pilot pins to adjust the positioning of the stock in the press prior to stamping, it is necessary to momentarily remove the tension on the stock 12 each time the pilot pins contact the stock. At all other times, however, it is desirable to keep the stock 12 under tension from rollers 22, 24. To allow the release of tension on the stock 12, roller 22 of the press feeder 20 is mounted to a support bracket 26 which is part of a pivotable arm assembly. The roller 22 is mounted within the support bracket 26 such that it is free to rotate. Also mounted within the support bracket 26 is pivot bearing 28 and connector bar 30. A release arm 32 of the arm assembly attaches to the connector bar 30 of the support bracket 26 by two bolts 34, one of which is shown in FIG. 2. This provides a rigid connection between the support bracket 26 and the release arm 32.

The release arm 32 is also connected to a roll bar 36 by a pin 38. The pivoting of the connection is restricted in one direction by adjusting screw 40. The screw 40 passes through a portion of the roll bar 36, and makes contact with the body of the release arm 32. Rotating the screw 40 thus changes the limit in one direction of relative angular motion of the release arm 32 and the roll bar 36.

Mounted to the roll bar 36 is a cam follower 42 which is braced in the roll bar 36 such that it is free to rotate. The cam follower 42 makes contact with cam 44 which is cylindrical except for eccentricity 46. The cam 44 is driven by a motor such that is rotates about an axis parallel to the rotational axis of the cam follower 42. Thus, as the cam rotates in a first direction, the cam follower 42 responds by rotating in the opposite direction, following the motion of the cam 44.

The rotation of the cam 44 and cam follower 42 is smooth until the eccentricity 46 of the cam makes contact with the cam follower 42. The elevated surface of the eccentricity 46 then displaces the cam follower away from the cam. Since the cam follower 42 is bound to the roll bar 36, the roll bar 36 is also displaced away from the cam 44. Since the relative rotational motion between the roll bar 36 and the release arm 32 is restricted by the screw 40, the movement of the cam causes the release arm to be moved as well. The release arm 32 is rigidly connected to the support bracket 26, and the motion of the release arm causes a pivoting about pivot bearing 28. This pivoting, in turn, causes the roller 22 to be moved away from the stock 12 and the bottom roller 24. As the arm assembly is pivoted, the support bracket 26 compresses spring 48, which ordinarily forces the roller 22 into contact with the stock, pressing it against roller 24.

At the moment this eccentricity 46 is forcing the pivoting of the arm assembly, the two rollers 22, 24 are separated, and the tension on the stock is removed. At this time, pilot pins of the press may be used to adjust the positioning of the stock. By directing the pilot pins into previously punched holes, the stock is drawn into alignment with the pilot pins. However, in order to achieve proper operation of the pilot release mechanism, a synchronizing of the pilot pins with the pilot release must be established. The size of the cam eccentricity may be selected to affect the distance of the roll separation, as well as the duration of the separation. An eccentricity which is higher causes a greater amount of pivoting. An eccentricity which is wider causes the rolls to be separated for a longer duration of time.

Figure 3:
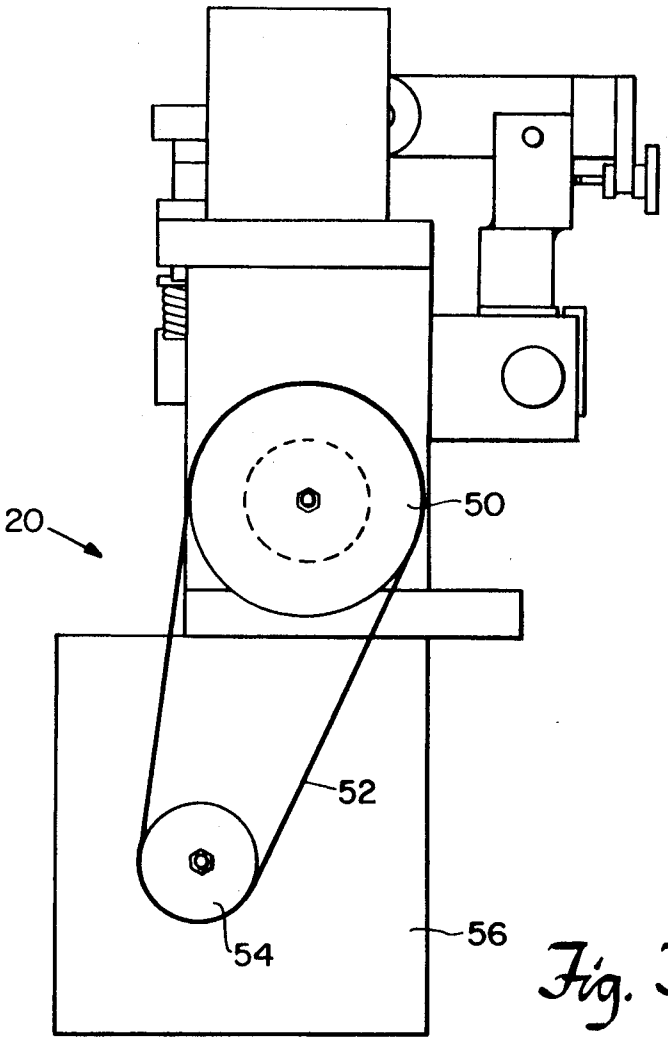
FIG. 3 is a side view of the press feeder of FIG. 2 with a pulley casing removed.

FIG. 3 is a side view of the press feeder 20 with a pulley casing (not shown) removed. As shown in the figure, a pulley 50 is mounted to the outside of the press feeder, and has a shaft which is connected to the shaft of the bottom pinch roller 24 of the press feeder 20. The pulley 50 is linked to a drive pulley 52 by a belt 54. The drive pulley 52 resides to the outside of motor casing 56, and is connected by a drive shaft to a motor within the casing. The speed of the motor driving pulley 54 is synchronized to the speed of the press 10 such that the progress of the stock 12 being fed into the press 10 is coordinated with the operations of the press on the stock.

The motor driving pulley 54 is controlled as necessary for the specific press feeding application. For example, a proximity switch may be used which closes when the press opens to signal the motor to feed in another length of stock material. Other feed operations may also be used as desired without affecting the operation of the present invention.

Figure 4:
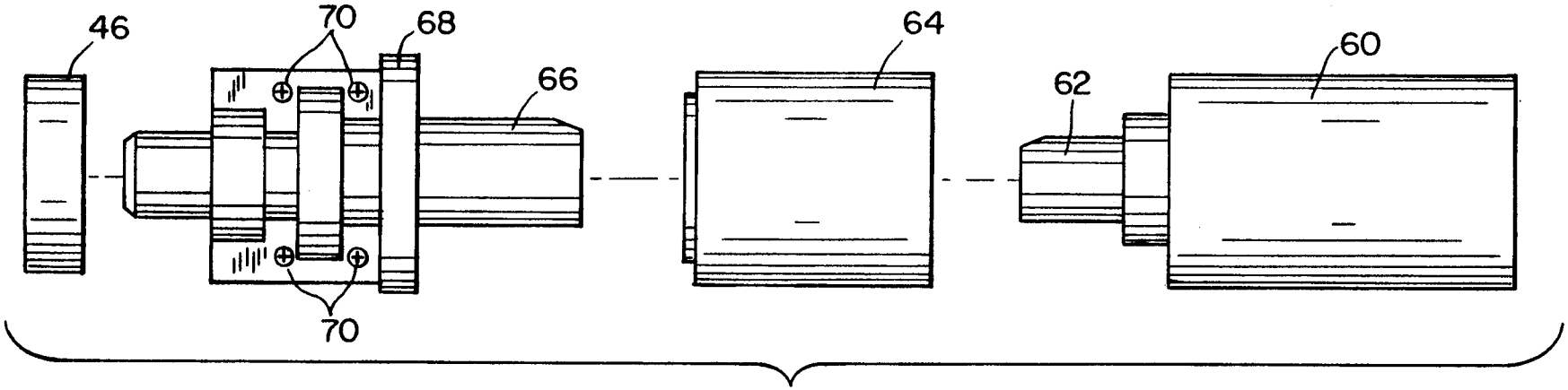
FIG. 4 is an exploded top view of linkage connecting a servo motor to a cam of a pivoting release mechanism.

In order to achieve the desired synchronization of the press stroke and the position of cam 46 which initiates the release of pinch rollers 22, 24, a servo motor is provided to drive the cam 46. FIG. 4 is an exploded view showing the linkage between a servo motor assembly 60 and cam 46. The servo motor 61 of the assembly is preferably a brushless low inertia servo motor with high temperature windings and an internal thermal protector. A shaft 62 of the servo motor 61 extends from a housing of the servo motor assembly 60 and rotates relative to the housing. The motor assembly 60 is rigidly connected to the top of the press feeder 20 by bolts or similar connection means (not shown). The end of shaft 62 is received by a coupler 64 which has a hollow receiving region on either side.

To the other side of the coupler 64 from the motor shaft 62 is a cam shaft 66 which is also received by the coupler 64. The coupler 64 is rigidly fastened to the motor shaft 62 and the cam shaft 66 such that rotational motion of the motor shaft is imparted to the cam shaft 66. Cam shaft 66 is held within a mounting bracket 68 which is secured to the top of the press feeder 20 with bolts 70. The mounting bracket 68 allows rotation of the shaft, but maintains the height of the cam shaft 66 and the cam 46 relative to the top surface of the press feeder 20. The cam shaft 66 has a portion 72 which has a diameter greater than the diameter of the holes in the mounting bracket 68 through which the cam shaft passes. This portion 72 is between two extending portions of the mounting bracket 68 to restrict lateral movement of the cam shaft 66. As shown in FIG. 4, the cam shaft 66 connects to cam 46 to the side of the mounting bracket 68 away from the servo motor assembly 60. Thus, as the servo motor 61 is driven, the rotation of the motor shaft 62 causes rotation of the cam 46 to initiate the pivoting roller release of the press feeder 20.

To properly synchronize the opening of the press feeder pinch rollers 22, 24 to the stroke of the press, the driving of the servo motor 61 is linked directly to the position of the crankshaft of the press 10. This ensures that the rollers 22, 24 open at the proper time relative to the stroke of the pres 10. The synchronization between the release of the press feeder rollers 22, 24 and the position of the press crankshaft is controlled by signal processor 72, shown schematically in FIG. 1. The position of the press crank shaft is determined from the output signal of a position sensor such as resolver 74. Many presses have such a position sensor already attached to the crankshaft. In such a case, the signal from that sensor may be used with the present invention, However, if no sensor is provided with the press, a sensor is easily retrofit to the press crankshaft to provide the desired output signal. In the preferred embodiment, the position sensor is resolver 74 shown graphically in FIG. 1.

In addition to press resolver 74, a resolver 76 is provided in the servo motor assembly 60 for generating a signal indicative of the position of the shaft 62 of the servo motor 61. Both the resolver 76 and the servo motor 61 are shown schematically in FIG. 1 as being part of the motor assembly. The position signal from each resolver 74, 76 is input to the signal processor 72, and the controller compares the signals to establish the relative orientation of the press crankshaft and the servo motor shaft 62. Using this information, the desired rotation of the servo motor shaft 62 is controlled by a controlling output signal from the signal processor 72 to the servo motor 61.

Each of the resolvers 74, 76 of the present invention is a conventional resolver having a single winding rotor and a two-winding stator. The rotors of resolvers 74, 76 are attached to the shafts of the press crankshaft and the servo motor shaft 62, respectively. For the press resolver 74, a reference signal generated by the signal processor 72 is output to the rotor coil of the resolver 74 along lines RH and RL. If the resolver built into the press is being used, the reference signal of the built-in resolver is input to the signal processor 72 along lines RH and RL. Whether originating in a built-in resolver or in the signal processor 72, the reference signal induces a signal in each of the two coils of the resolver stator. As the shaft rotates from a top dead center position, the rotor rotates with it, and the signals induced in the two stator coils change.

At any rotational position of the press crankshaft, the signals output from the stator coils are each at the frequency of the reference signal. However, as the shaft rotates, the magnitude of the signals change. In the preferred embodiment, the rotor of the resolver 74 is attached to the crankshaft such that the angle between the rotor and the stator is zero when the crankshaft is at top dead center. However, this relative positioning between the crankshaft and the resolver 74 can be adjusted to suit any particular application.

The signal induced in one of the stator coils is output along lines COSH and COSL, and represents the cosine of the angle between the rotor and the stator of the resolver 74. Similarly, the signal induced in the second stator coil is output along lines SIHN and SINL, and represents the sine of the angle between the rotor and the stator of the resolver 74. Since the rotor is attached to the press crankshaft, and is at an angle of zero when the shaft is at top dead center, the cosine and sine outputs of the resolver also represents the cosine and sine of the angle of the press crankshaft relative to top dead center. The cosine and sine signals are input to the signal processor 72 for use in controlling the rotation of the servo motor shaft 62 for rotating cam 46 of the press feeder 20.

Figure 5A:
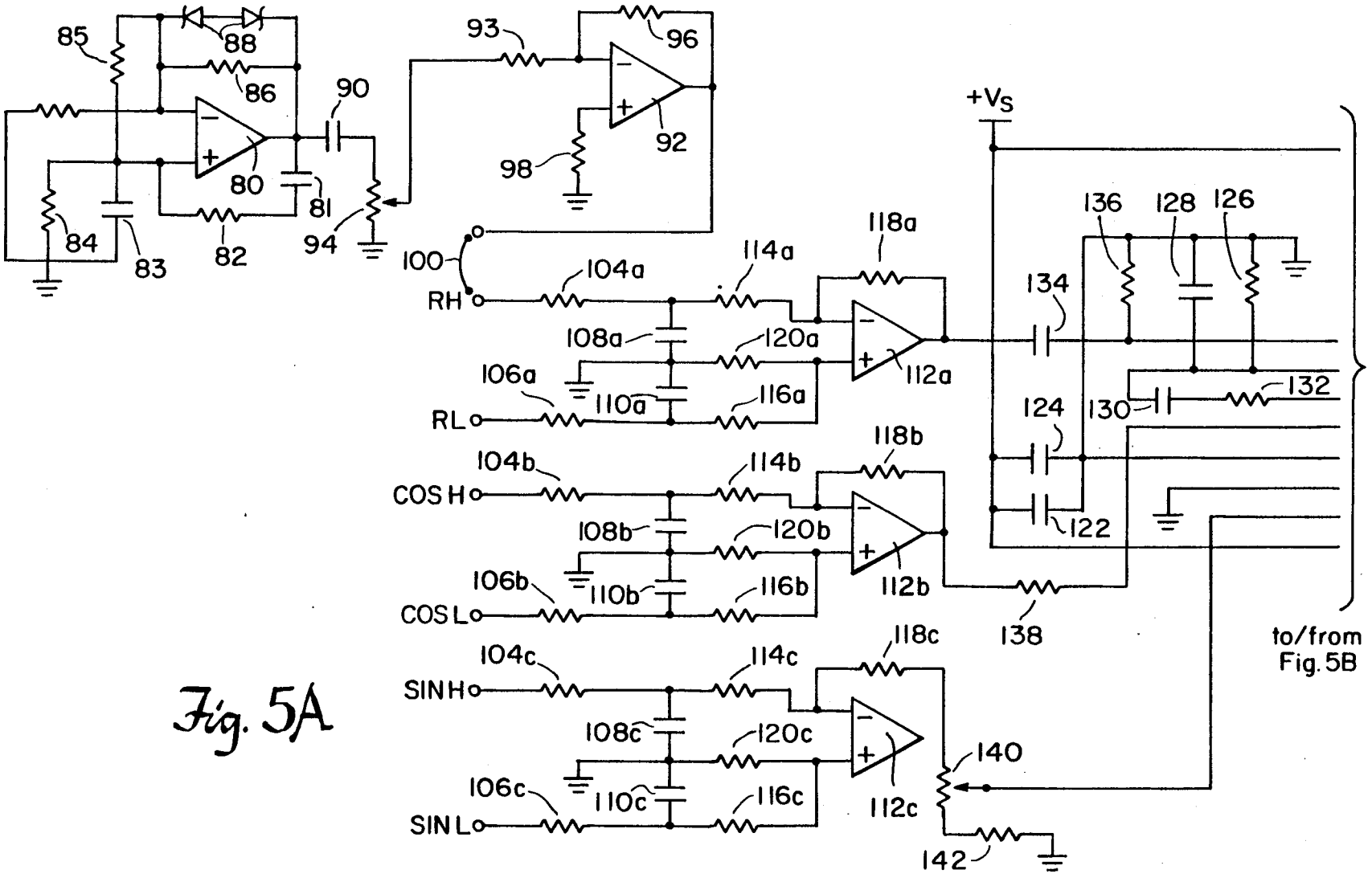
FIG. 5A and B is a schematic of the resolver-to-digital converter circuitry of the present invention.
Figure 5B:
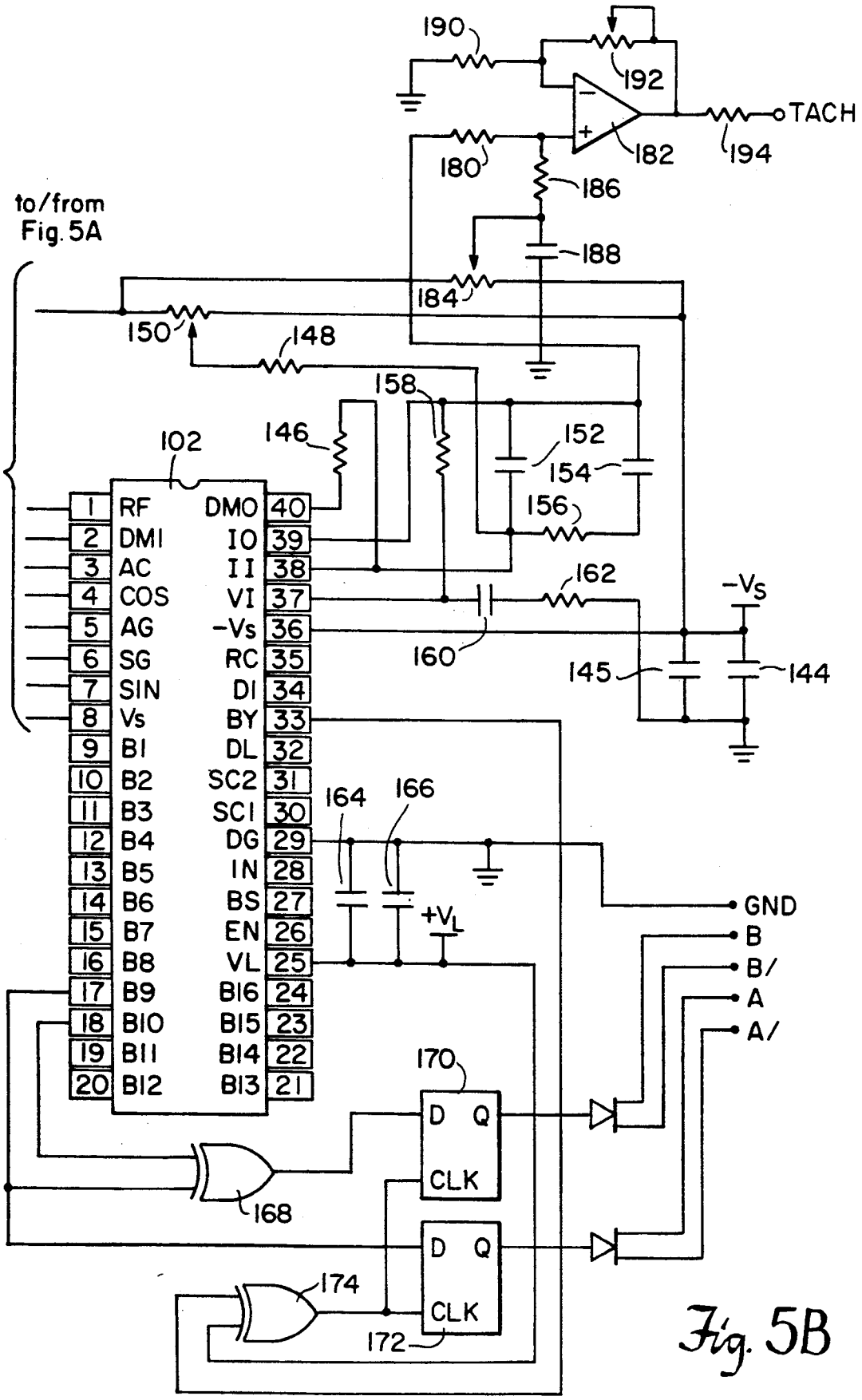

Shown in FIG. 5 is an input portion of the signal processor 72. For generating a reference signal for use with resolver 74, an oscillator circuit is shown which uses operational amplifier (op-amp) 80. As shown, op-amp 80 is provided with phase-shifted positive feedback via capacitors 81 and 83 and resistors 82 and 84. Capacitor 83 provides coupling between the positive input terminal and the negative input terminal of the op-amp 80. Resistors 85, 86 are used in the negative feedback leg of the op-amp, along with voltage limiting zener diode pair 88, which bypass resistor 86. The alternating signal output by amplifier 80 is high pass filtered by capacitor 90, and fed into the negative input terminal of buffer amplifier 92 through resistor 93 and variable resistor 94. Feedback resistor 96 provides negative feedback from the output of amplifier 92, and the positive input terminal is grounded through resistor 98. The output of amplifier 92 (when referenced to ground) is the desired reference signal for input to resolver 74. It will be understood by one skilled in the art that this oscillator circuit is just one example of a circuit which may be used to generate the desired reference signal, and other signal generating circuits may be substituted.

As shown in FIG. 5, the output of amplifier 93 is connected to the RH terminal by jumper wire 100. If the press 10 has a built in resolver, this jumper 100 is removed and the reference signal of the press resolver is used. Each of the signals RH/RL, COSH/COSL, and SINH/SINL is connected to a resolver-to-digital converter 102 via a noise control circuit. In the preferred embodiment, the converter is a variable resolution, monolithic resolver-to-digital converter such as the Model 2S80, made by Analog Devices Corp., Norwood, Mass. Each of the noise control circuits is essentially the same, and therefore the following description applies to each of the three circuits. Therefore, in the description, the same reference numeral is used to identify similar elements in each noise control circuit. However, for ease of identification, each reference numeral in the figure is also followed by a letter which designates the circuit with which it is associated. The reference numerals for the noise circuit having input terminals RH and RL are followed by the letter "a", the reference numerals for the noise circuit having input terminals COSH and COSL are followed by the letter "b", and the reference numerals for the noise circuit having input terminals SINH and SINL are followed by the letter "c".

The input legs of each noise control circuit have load resistors 104 and 106. Following the load resistors 104, 106 are filtering capacitors 108, 110. Each of the capacitors 108, 110 ties one of the input legs to ground to provide high pass filtering of the input signal. The input signals are then fed into the input terminals of amplifier 112 through resistors 114, 116. Feedback is provided to the negative terminal of the amplifier 112 through resistor 118. The positive input terminal is also tied to ground through resistor 120. By selecting the values of resistors 118 and 120, any desired voltage gain may be produced from the noise control circuit.

The resolver-to-digital converter 102 compares the reference signal, the cosine input signal and the sine input signal, and outputs a 16-bit word representative of the angle of rotation of the press crankshaft. In the embodiment of FIG. 5, the pin arrangement of the converter 102 corresponds to the Analog Devices 2S80. The electrical connections are also made in accordance with the required specifications of the Analog Devices 2S80. However, it will recognized by one skilled in the art that other circuits may be used which perform the necessary conversion of the resolver signal inputs.

Source voltage $V_s$ is supplied to the $V_s$ input of the converter 102, and is filtered through capacitor 122 which connects to ground. Voltage $V_s$ is also connected to the analog ground (AG) input of the converter 102 via blocking capacitor 124. The demodulator input (DMI) is connected to ground via the parallel arrangement of resistor 126 and capacitor 128. The DMI input is also connected to the AC error input (AC) via the series connection of capacitor 130 and resistor 132. The combination of elements 126, 128, 130, and 132 makes up a high frequency filter required by the Analog Devices 2S80 package. The signal ground (SG) input is tied to ground.

The reference signal output from amplifier **112*a* is input to the reference (REF) input of the converter 102. A blocking capacitor 134 connects the reference signal to input REF, and a ground connection is provided through resistor 136. This provides AC coupling of the reference input. Similar to the reference signal input, the output of amplifier 112*b*** is input to the cosine (COS)

input through resistor 138. The output of amplifier 112c is input to the sine (SIN) input of the converter 102 through variable resistor 140, which has a third branch tied to ground via resistor 142.

On the other side of the converter package, voltage input $-V_s$ is input to input $-V_s$ of the converter 102. Capacitors 144 and 145 are tied between $-V_s$ and ground to provide filtering of the voltage $-V_s$. Additional circuitry required of the Analog Devices 2S80 is also shown in the figure, as the demodulator output (DMO) is connected to integrator input (II) via gain scaling resistor 146. Also connected to the II input are resistor 148 and variable resistor 150, which together make up an offset adjust arrangement. Resistor 150 is a variable resistor connected between $V_s$ and $-V_s$, and which has a center tap which feeds to input II via resistor 148. This allows a bias current to be fed into the II input for offset adjustment purposes.

Resistor 158, connected between the integrator output (IO) and the voltage controlled oscillator (VCO) input (VO), and is chosen to with regard to the desired maximum tracking rate of the converter 102. By tying input SC1 to ground, the resolution of the converter 102 is set to 12- bits. Thus, with the value of resistor $R_{158}$ selected as 190kΩ in the preferred embodiment, the maximum tracking rate of the converter 102 is about 75 revolutions per second, satisfying the design equation:

$$R_{158}=(5.92\times10^{10})/(T\times P)$$

Where T is the maximum tracking rate in revolutions/-second, and P is the number of bits per revolution. In the preferred embodiment, the number of bits per revolution for 12-bit resolution is 4096.

Connected between the II input, the integrator out (IO) output, and resistor 148 is closed loop bandwidth selection circuitry (also required for the Analog Devices 2S80). The values for capacitor 152 ($C_{152}$), capacitor 154 ($C_{154}$), and resistor 156 ($R_{156}$) are selected to ensure that the closed loop 3 dB bandwidth ($f_{BW}$) is less than $(0.4)f_{REF}$, where $f_{REF}$ is the frequency of the reference signal. To satisfy this requirement, a desirable bandwidth value should be chosen, and the values of the components selected to satisfy the following sequence of equations:

$$C_{152}=20.2/(R_{158}\times f_{BW}),$$

$$C_{154}=5(C_{152}),\text{ and}$$

$$R_{156}=4/(2\pi\times f_{BW}\times C5)$$

The IO output is also used to generate a signal TACH which has a magnitude proportional to the rotational speed of the press shaft. The IO signal is input through resistor 180 to the positive input terminal of amplifier 182. Through resistor 186, the positive terminal is also tied to a bias adjustment variable resistor 184, which is connected between the $+V_s$ and the $-V_s$ voltage terminals. Capacitor 188 is tied to ground to provide filtering. The negative input terminal of the amplifier 182 is tied to ground through resistor 190, and also has a feedback signal through variable resistor 192. The signal TACH is generated by amplifier 182, the output of which is fed through output resistor 194, and can be used as an input to a display monitor or as an information signal for an external controller.

In addition to the above, the converter 102 also requires the use of VCO phase compensation in the form of capacitor 160 and resistor 162 shown connected between input VI and ground. Voltage $V_L$ is also shown input to the $V_L$ input of the converter 102. $V_L$ is a logic power supply, and is filtered to ground by capacitors 164, 166. The digital ground input (DG) of the convert 102 is also tied to ground.

As shown in FIG. 5, only two of the output bits of the converter 102 are used by the present invention. Bits 9 and 10 output at pins B9 and B10 of the converter are used in a gating arrangement to extract desired information about the position of the press crankshaft. Outputs B9 and B10 are input to EXOR gate 168, the output of which is input to the D input of D-type flip-flop 170. In addition, output B9 is input to the D input of flip-flop 172. Both flip-flops Have a clock input from EXOR gate 174, which has a first input tied to $V_L$ and a second input from the "busy" (BY) output of the converter 102. The busy output is high during the time that output data of the converter is not valid, so that during this time the output of EXOR gage 174 is low. The flip-flops are latched by the rising edge of the CLK inputs, so that when the busy output goes low, indicating that valid data is present, the output of gate 174 goes high, latching the new data into the flip-flops 170, 172.

The data latched by flip-flop 172 is just the B9 bit of the converter 102 output. Thus, flip-flop 172 output A will follow the changes of bit B9. However, the data latched by the flip-flop 170 is the EXOR combination of bits B9 and B10. Since bit B9 is a higher order bit than bit B10, the progress of outputs A and B, as the press crankshaft rotates in a first direction, is as follows:

| Bit B9 | Bit B10 | Output A | Output B |
|---|---|---|---|
| 0 | 0 | 0 | 0 |
| 0 | 1 | 0 | 1 |
| 1 | 0 | 1 | 1 |
| 1 | 1 | 1 | 0 |

So the output A of flip-flop 170 lags the output B of flip-flop 172 if the shaft is rotating in a first direction. However, if the shaft is rotating in the opposite direction, the output A leads the output B. The output signals generated at output A and output B are demonstrated in FIG. 6. As shown in the figure, the relationship between output A and output B is such that a 90° phase shift exists between the two signals. The outputs of flip-flops 170 and 172 are input to dual output buffers 172 and 173, respectively. The buffers provide current sourcing and sinking, and provide inverted outputs as well as the non-inverted outputs. Thus, the outputs of buffer 171 are B and B/, and the outputs of buffer 173 are A and A/, where the symbol "/" indicates the inverted form of the indicated signal.

Figure 6A:
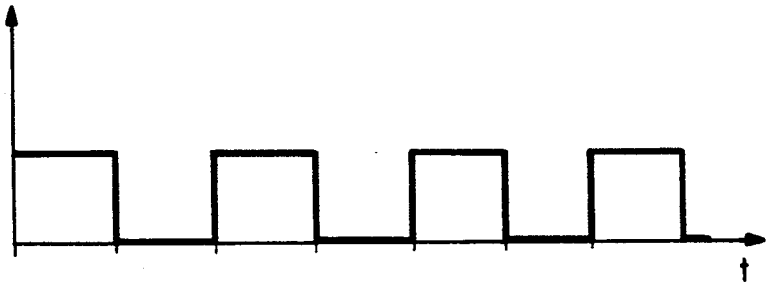
FIG. 6A and B is a graph of the relationship between two output signals of the circuitry of FIG. 5.
Figure 6B:
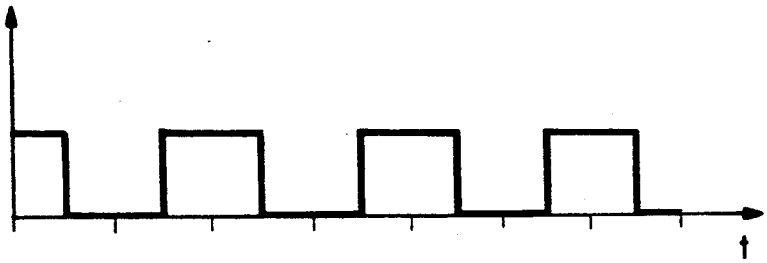

The output signals A and B provide the information necessary to drive the servo motor 61 in synchronization with the press crankshaft resolver 74. Shown in FIG. 6 is a servo motor control circuit of the signal processor 72 which processes the signals A and B. The heart of the motor control circuit is servo motor controller 200. Motor controller 200 is a commercially available circuit which receives the inputs from buffers 171, 173, and inputs from servo motor resolver 76. The controller 200 processes the resolver information, and generates the outputs necessary to drive servo motor 61. In the preferred embodiment, the controller 200 is a model SC452 Brushless DC Servo Motor Controller, produced by IMEC corporation. Thus, the arrangement of the controller inputs in FIG. 7 corresponds to the IMEC controller. However, it will be recognized by one skilled in the art that other types of motor control circuitry can be substituted for the IMEC SC452, including other commercially available circuit options.

Signals input to the controller from the converter 102 circuitry include the digital ground (GND), the non-inverted and inverted outputs of buffer 171 (B and B/, respectively), an the non-inverted and inverted outputs of buffer 173 (A and A/, respectively). As shown in the figure, GND is input to the "COMMON" input of the controller 200, and A, A/, B, and B/ are input to the A, A/, B, and B/ inputs of the controller 200, respectively.

Figure 7:
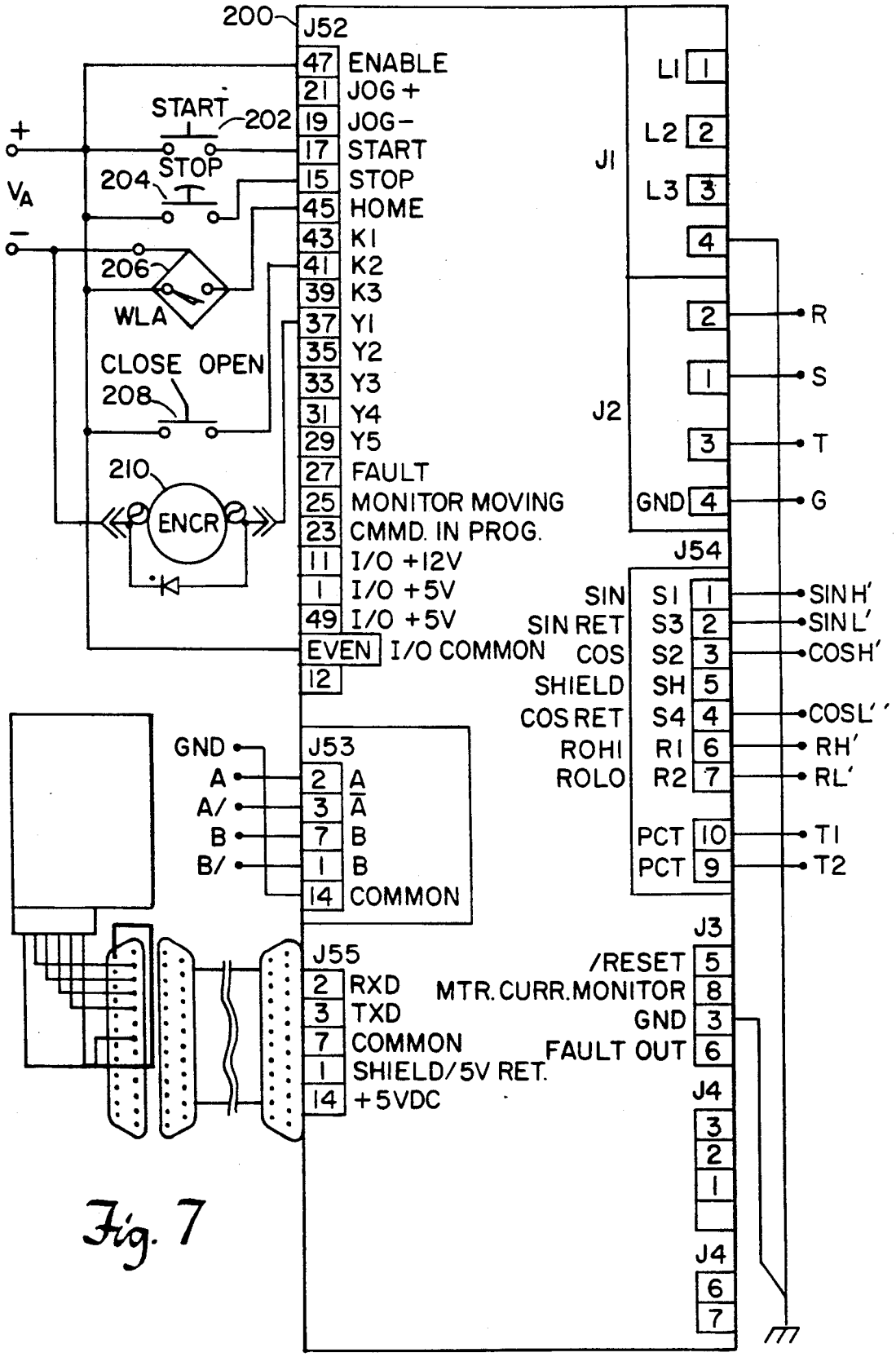
FIG. 7 is a schematic of the servo motor control circuitry of the present invention.

The controller 200 also receives signals from the servo motor resolver 76. The signals shown output from the resolver 76 in FIG. 1 are input to the controller 200 so the rotational position of the servo motor shaft can be determined. These signals include COSH', COSL', SINH', SINL', RH', and RL'. As shown in FIG. 7, these signals are input to controller inputs COS, COSRET, SIN, SINRET, ROHI, and ROLO, respectively.

As shown in FIG. 7, the servo motor inputs R, S, T, and G are connected to the controller 200 which generates signals in response to resolver information received. Input G is a ground connection, while each of inputs R, S, and T are connected to one of the three power inputs of the servo motor 61, each of which corresponds to one the three motor coils of the servo motor 61. The controller 200 reads the inputs from the converter 102 circuitry, and modifies the driving of the servo motor 61 until the inputs from the resolver 76 indicate that the rotation of the servo motor 61 is synchronized with the rotation of the press crankshaft.

Other inputs provided for manually controlling the servo motor are also shown in FIG. 7. A DC voltage $V_A$ is shown supplying power to several input switches. A "start" switch 202 is connected between $V_A$ and the START input of the controller. If the motor is idle when the start switch 202 is pressed, the controller begins driving the motor 61. Similarly, a "stop" switch 204 is connected between $V_A$ and the STOP input of the controller 200. If the stop switch 204 is depressed while the servo motor 61 is being driven, the controller reads the input, and correspondingly stops driving the motor 61.

A proximity switch 206 is shown schematically in FIG. 7, providing a signal to the HOME input of the controller 200. The switch 206 is attached to the pilot release camshaft and is positioned at top dead center position of the camshaft. Thus, when the camshaft is at top dead center, a HOME signal is input to the controller. In the preferred embodiment, the switch 206 is a magnetic proximity switch, but a limit switch may be substituted. The HOME signal is used by the controller for quickly finding top dead center on the press stroke.

In the preferred embodiment, top dead center is at the top of the press stroke, at which time the press feeder rolls 22, 24 are closed. If the servo motor 61 is aligned with the stroke of the press, the position of the motor 61 is 180° when the rolls 22, 24 are open. At the bottom of the press stroke (180° from the HOME position), the rolls 22, 24 are open to allow adjustment of the stock being fed into the press 10. To allow a user to manually open or close the rolls 22, 24, a "close/open" switch 208 is provided with the controller 200. The switch 208 is connected between $V_A$ and the K2 input shown on the controller 200 in FIG. 7. When the the servo motor 61 is idle, a depressing of the switch 208 results in the controller moving the servo motor to either 0° or 180° relative to its "home" position, depending of the position of the motor at the time the switch 208 is depressed. If the motor position is less than 180°, depressing switch 208 causes the controller to move the motor 61 to the 180° position to open the rolls 22, 24. If the motor position is greater than or equal to 180°, then depressing switch 208 causes the controller to move the motor 61 to 0°, thus closing the rolls 22, 24.

Also shown in FIG. 7 is enable relay 210. The relay 210 is opened by the controller if the motor driving the pinch rollers of the press feeder 20 is disabled. The relay closes again when the power to the motor is resumed. As shown in the figure, the relay is connected between the negative pole of voltage source $V_A$ and the Y1 input of the controller.

The IMEC controller 210 is a microprocessor driven circuit, and desired motor functions can therefore be programmed into the controller 210 in accordance with IMEC specifications. A remote terminal 212 is shown in FIG. 7 connected by a ribbon cable connector 214. In the preferred embodiment, the terminal 212 is a Terminiflex ST/32A terminal. Once programming of the controller 200 is complete, the terminal is disconnected and the controller 200 runs independently.

While the invention has been particularly shown and described with reference to a preferred embodiment thereof, it will be understood by those skilled in the art that various changes in form in details may be made therein without departing from the spirit and scope of the invention as defined by the appended claims. For example, the particular electronics described above for adapting the servo link between the press and the servo motor of the press feeder may be modified. Similarly, the particular arrangement of the cam and the pivoting release can be changed without substantially altering the basic premise of the present invention.

The use of a cam-driven, pivoting pilot release synchronized to a press by a servo motor, allows press speeds of 1500 strokes/second and above. Without physical coupling to the press, the press feeder may be located to suit an application, and may be retrofit to an existing press arrangement without changing the press arrangement. This versatility greatly exceeds the that of prior press feeder arrangements, which were bound by a belt or other type of physical coupling to the press.

I claim:

1. An apparatus for feeding stock material into a press driven by a shaft, which press uses pilot pins to align the stock material in the press, the apparatus comprising:

a housing a first rotatable pinch roller secured to the housing;

a second rotatable pinch roller positionable adjacent the first pinch roller such that stock material may be fed between the rollers under tension from the rollers;

a pivotable support to which the second pinch roller is secured, and wherein a pivoting of the support in a first direction causes the second pinch roller to move away from the first pinch roller;

a spring element providing a bias which urges the second pinch roller toward the first pinch roller;

a cam follower secured to the pivotable support;

a movable cam in contact with the cam follower such that a movement of the cam initiates a pivoting of the pivotable support against the bias of the spring element;

a sensor sensing the position of the press shaft and generating a press position signal indicative thereof;

a signal processor receiving the press shaft position signal and generating a motor control signal in response thereto; and a servo motor for receiving the motor control signal from the signal processor and causing movement of the cam in response thereto.

2. An apparatus according to claim 1, wherein movement of the cam is synchronized with the press shaft such that it initiates the pivoting of the pivotable support when the pilot pins of the press are in contact with stock material in the press.

3. An apparatus according to claim 1, further comprising a travel adjust screw connected to the pivotable support which when turned changes the magnitude of the pivoting of the support resulting from the cam movement.

4. An apparatus according to claim 1, wherein the cam has an eccentricity of a predetermined height selected in proportion to a desired magnitude of pivoting of the pivotable support, and a width selected in proportion to the desired duration of said pivoting.

5. An apparatus according to claim 1, wherein the sensor is a position sensor.

6. An apparatus according to claim 5, wherein the position sensor is a resolver.

7. An apparatus according to claim 1, wherein the servo motor comprises a position sensor which senses the position of the servo motor shaft and outputs a servo position signal to the signal processor indicative of the servo motor position.

8. An apparatus according to claim 1, wherein the signal processor comprises an analog-to-digital converter.

9. An apparatus according to claim 1, wherein the signal processor comprises a motor controller.

10. An apparatus according to claim 9, wherein the motor controller comprises a start switch for initiating motion of the servo motor.

11. An apparatus according to claim 9, wherein the motor controller comprises a stop switch for stopping rotation of the servo motor.

12. An apparatus according to claim 9, wherein the motor controller comprises an open/close switch for advancing the position of the motor shaft incrementally.

13. An apparatus for feeding stock material into a press which uses pilot pins to align the stock material in the press, the apparatus comprising:

a housing;

a first rotatable pinch roller secured to the housing;

a second rotatable pinch roller positionable adjacent the first pinch roller such that stock material may be fed between the rollers under tension from the rollers;

a pivotable support to which the second pinch roller is secures, and wherein a pivoting of the support in a first direction causes the second pinch roller to move away form the first pinch roller;

a spring element providing a bias which urges the second pinch roller toward the first pinch roller;

a cam follower secured to the pivotable support;

a movable cam in contact with the cam follower such that a movement of the cam initiates a pivoting of the pivotable support against the bias of the spring element;

a travel adjustment mechanism for adjusting the extend of the pivoting of the .pivotable support in response to the movement of the cam;

a servo motor causing rotation of the cam;

a press position sensor sensing the position of the press and generating a press position signal indicative thereof;

a servo position sensor sensing the position of a shaft of the servo motor, and generating a servo position signal indicative thereof; and a signal processor for receiving the press position signal and the servo position signal and generating a motor control signal in response thereto, the motor control signal being input to the servo motor to control operation of the servo motor such that rotation of the servo motor shaft is synchronized to the position of the press.

14. A method of feeding stock material into a press which uses pilot pins to align the stock material in a press which has a shaft for driving the press, the method comprising:

feeding the stock between a pair of pinch rollers one of which is pivotably supported by a support member;

biasing the pivotable pinch roller toward the other pinch roller;

sensing the position of the press shaft and generating a press position signal indicative thereof;

generating a motor control signal in response to said press position signal; and driving a cam in response to; the motor control signal, which cam is coupled to the support member for pivoting the support member to vary the bias of the pivotable pinch roller.

15. A method according to claim 14 further comprising synchronizing the driving of the cam by the servo motor with the press shaft position such that the cam initiates pivoting of the support member when the pilot pins of the press are in contact with stock material in the press.

16. A method according to claim 14 further comprising changing the magnitude of the pivoting of the pivotable support which results from movement of the cam.

17. A method according to claim 14 further comprising changing the eccentricity of the cam by a height selected in proportion to a desired magnitude of pivoting of the pivotable support which results from movement of the cam, and by a width dimension selected in proportion to a desired duration of said pivoting.

18. A method according to claim 14 wherein a resolver senses the position of the press shaft.

* * * * *

UNITED STATES PATENT AND TRADEMARK OFFICE

CERTIFICATE OF CORRECTION

PATENT NO. : 5,150,022

DATED : September 22, 1992

INVENTOR(S) : John E. Waddington

It is certified that error appears in the above-identified patent and that said Letters Patent is hereby corrected as shown below:

Claim 13, col. 11, line 61, delete "secures" and insert ---secured---.

Claim 13, col. 12, line 2, delete "form" and insert ---from---.

Claim 13, col. 12, line 11, delete "extend" and insert ---extent---.

Claim 14, col. 12, line 39, after "and" insert a new paragraph.

Claim 14, col. 12, line 40, delete ";" after ---to---.

Signed and Sealed this

Twenty-eighth Day of June, 1994

Bruce Lehman

*Attest:*

BRUCE LEHMAN

*Attesting Officer*

*Commissioner of Patents and Trademarks*